US005689085A

United States Patent [19]

Turner

[11] Patent Number: 5,689,085

[45] Date of Patent: Nov. 18, 1997

[54] EXPLOSIVE DISPLACING BORE HOLE TUBE

[76] Inventor: Wayne G. Turner, R.R. 2, Box 257, Manchester, Iowa 52057

[21] Appl. No.: 524,260

[22] Filed: Sep. 6, 1995

[51] Int. Cl.[6] ..... F42B 3/00; E21B 33/00

[52] U.S. Cl. ..... 102/313; 102/312; 166/63; 166/135

[58] Field of Search ..... 102/312, 313, 102/333; 166/63, 135

[56] References Cited

U.S. PATENT DOCUMENTS

| | | | |
|---|---|---|---|
| 167,465 | 9/1875 | Oliver . | |
| 168,795 | 10/1875 | Smith et al. . | |
| 176,989 | 5/1876 | Oliver . | |
| 229,845 | 7/1880 | Sager | 102/312 |
| 969,186 | 9/1910 | Peters . | |
| 3,148,580 | 9/1964 | Brown | 86/20 |
| 3,366,056 | 1/1968 | Thunell et al. | 102/30 |
| 3,422,760 | 1/1969 | Mohaupt | 102/313 X |
| 3,707,188 | 12/1972 | Heckman | 102/312 |
| 4,090,447 | 5/1978 | Johnsen | 102/23 |
| 4,487,129 | 12/1984 | Isaac | 102/313 |
| 4,846,278 | 7/1989 | Robbins | 102/333 X |
| 5,198,613 | 3/1993 | Jenkins, Jr. | 102/313 |
| 5,253,586 | 10/1993 | Worsey | 102/313 |
| 5,273,110 | 12/1993 | Fitzgibbon, Jr. | 102/333 X |
| 5,551,344 | 9/1996 | Couet et al. | 102/313 X |

*Primary Examiner*—Peter A. Nelson
*Attorney, Agent, or Firm*—Donald R. Schoonover

[57] ABSTRACT

An explosive displacing bore hole tube is formed by an elongated tubular member having opposite ends thereof closed, as by caps, to enclose a nonexplosive material within the tube. The nonexplosive material is preferably nonpressurized air; bore hole cuttings or other material may be added for ballast. Alternatively, the tube may be completely filled with such cuttings. The explosive displacing tube is positioned within a bore hole along with a bulk flowable explosive to reduce the volume of explosive at a selected location or locations along the bore hole to thereby reduce the blast intensity at such a location or locations when the explosive is detonated. A tube filling apparatus is provided for simultaneously placing ballast in a plurality of the tubes.

21 Claims, 2 Drawing Sheets

EXPLOSIVE DISPLACING BORE HOLE TUBE

BACKGROUND OF THE INVENTION

Explosives are used in construction and mining to fragment solid rock so it can be removed. A number of blast holes are drilled in spaced relation to a free vertical rock face and filled with explosive charges which are detonated to produce shock waves that rupture the surrounding rock. A number of factors control the character of the blast, including: the geologic structure of the blast site; the size and spacing of the blast holes; the burden or distance of the free face of the rock surrounding the blast hole; the type, amount, and placement of the explosive; the sequence of detonation; and the stemming technique used. Stemming is the plugging of the blast hole to prevent undesired escape of the blast gases.

In mining to recover ores and in quarrying operations to produce rock which will be crushed for gravel, blasting is conducted in such a manner as to create "shot rock", that is, relatively small sized rock which can be conveniently processed by rock crushing machinery. Larger sized rock or boulders, referred to as "rip-rap" is also produced, as for erosion control along river banks and the like.

To produce shot rock, an explosive such as ammonium nitrate-fuel oil or ANFO is loaded to a relatively high level in the bore hole and detonated by an electrical cap booster located near the bottom of the hole. One problem with loading the explosive high in the bore hole is that the increased energy tends to blow out the rock at the top of the hole creating "fly rock" which may be propelled at high speeds, such as toward workers, vehicles, and crushing equipment. To avoid this, the height of the explosive in the hole is reduced, and the space is filled with an extra amount of bore hole cuttings. Cuttings are produced as the bore hole is drilled. However, this tends to produce large rocks or boulders toward the top of the hole.

When the purpose of the blast is to produce boulders or rip-rap, the hole is "decked". This involves alternating layers or decks of explosive and cuttings, each layer of explosive having a booster. The boosters are connected in sequence by explosive primer cord, and the lowest layer has an electrical cap and a booster to which the lower end of the primer cord is connected. Detonation is sequential from the bottom to the top, each primer cord section setting off the next booster above. The zones with the cuttings receive less intensive shock and, thus, fracture in a manner that creates the desired larger fragments. The processing of decking the explosives, boosters, and cuttings is time consuming and laborious.

Blasting sometimes leaves concavities in the rock face, referred to as blow-outs. When a bore hole is filled with explosive and detonated in the vicinity of a blow-out, the blow-out tends to produce fly rock. To prevent this, the hole is filled with explosive up to a zone near the blow-out, which is packed with cuttings, then the remainder of the hole is filled with explosive and plugged at the top with cuttings. Each section of explosive has a detonator placed in it. The zone of cuttings reduces the intensity of the blast in this area, which reduces the tendency to produce fly rock in the area of the blow-out. However, an extra detonator is generally required along with the need for loading the zone of cuttings.

SUMMARY OF THE INVENTION

The present invention provides a structure for facilitating the control of bore hole blasting operations which is simple and economical by providing an explosive displacing bore hole tube which can be quickly and conveniently placed in a bore hole in zones where the intensity of the blast is required to be diminished. The displacement tube is formed of cylindrically tubular stock constructed of a synthetic resin, and the ends are closed by caps or plugs. The preferred tube is about four feet in length and has a diameter about half that of the bore hole, such as 2.5 inches diameter for a five inch diameter bore hole, etc. The tube is filled with a nonexplosive material, which may consist mostly of air. An amount of ballast, such as cuttings, may be included to reduce buoyance and to facilitate lowering the tube into the bore hole. The tube may also be completely filled with cuttings in some cases. Preferably, the tube is relatively thin walled and may be of a material which is biodegradable.

The presence of the displacement tube within the explosive in the bore hole displaces a volume of explosive equal to the volume of the displacement tube, thereby reducing the intensity of the blast in the vicinity of the displacement tube. However, since some explosive still surrounds the tube, the use of extra detonators and boosters on opposite sides of the tubes is reduced in some operations. The tube can be used in place of zones of cuttings, except for the stemming plug at the top of the bore hole.

In the production of shot rock, a displacement tube is placed at the top of the column of explosive, just below the top plug. In such a case, the tube may be filled with cuttings, if desired. The use of the displacement tube reduces the tendency to produce fly rock which would occur if the explosive were loaded to the same height in the bore hole without the displacement tube. Additionally, since some explosive is present higher in the bore hole than if only cuttings were used, there is less of a tendency to produce boulders at the top.

In the production of rip-rap, a string of displacement tubes is placed along the bore hole instead of the conventional decking of cuttings. The spacing interval is similar to the deck spacing, which is determined by the size of the rip-rap to be produced. The placement of the string of displacement tubes, as well as the intervening boosters on primer cord, is much less laborious and time consuming than conventional decking with zones of cuttings.

To deal with blow-outs, a displacement tube is positioned in the vicinity of the blow-out to reduce the blast intensity at this location and, thereby, reduce the production of fly rock from the blow-out. The placement of the displacement tube is, again, quicker and more convenient than the conventional use of a layer of cuttings.

The present invention provides an arrangement for placing cuttings or other ballast into a plurality of displacement tubes simultaneously. The displacement tube filler apparatus includes a lower tube stand assembly to support a plurality of tubes in upstanding parallel relation and an upper funnel assembly with a plurality of funnel members which are inserted into the top ends of the upstanding tubes. The curings can then be shoveled into the group of tubes, all at the same time. The tube stand assembly includes a pail having a plurality of tube supporting sleeves positioned upright on a lower wall of the pail. The sleeves and the lower wall may include apertures to allow outflow of excess ballast. The displacement tubes, with lower ends capped or plugged, are inserted into the sleeves. The funnel assembly includes an outer peripheral wall supporting a transverse funnel support disk. The disk has a plurality of apertures which receive respective funnels, formed by conically tapered members. The funnels are inserted into the tops of the upstanding tubes supported by the tube stand to funnel the ballast into the tubes. The displacement tube filler is self-standing. Once the displacement tubes are filled to the desired height, the funnel assembly is removed, and each of the tubes can then be capped or plugged at the top end and taken or transported to the bore holes.

OBJECTS AND ADVANTAGES OF THE INVENTION

The principal objects of the present invention are: to provide an improved device for use in blasting; to provide such a device particularly for the control of blast intensity at selected locations along bore holes; to provide such a device for use particularly with flowable and slurry type explosives such as ammonium nitrate/fuel oil (ANFO); to provide such a device which displaces a portion of the volume of explosive along a selected length of the bore hole to thereby reduce the intensity of blast at such a location in the bore hole; to provide such a device which leaves a portion of the volume of explosive along the selected location to transfer detonation of the explosive from one end of the device to the other, thereby omitting the need for separate detonators on both ends of the device in some circumstances; to provide such a device which reduces the setup time and labor in certain bore hole blasting operations; to provide such a device which replaces zones of bore hole cuttings separating zones of explosives within a bore hole; to provide such a device comprising an elongated tube with opposite ends closed and filled with a nonexplosive material, such as air or proportions of an inert ballast and air; to provide such an explosive displacing tube which may be formed from economical materials, such as plastic tubing; to provide a filler arrangement for simultaneously filling multiple explosive displacing tubes with ballast; to provide such a device which greatly facilitates operations to form shot rock without fly rock, to form rip-rap or boulders, and to blast in the vicinity of blow-out cavities in an adjacent rock face; and to provide such an explosive displacing bore hole tube which is economical to manufacture, which is convenient and efficient in use, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figures 1, 2, 3, 4, 5:
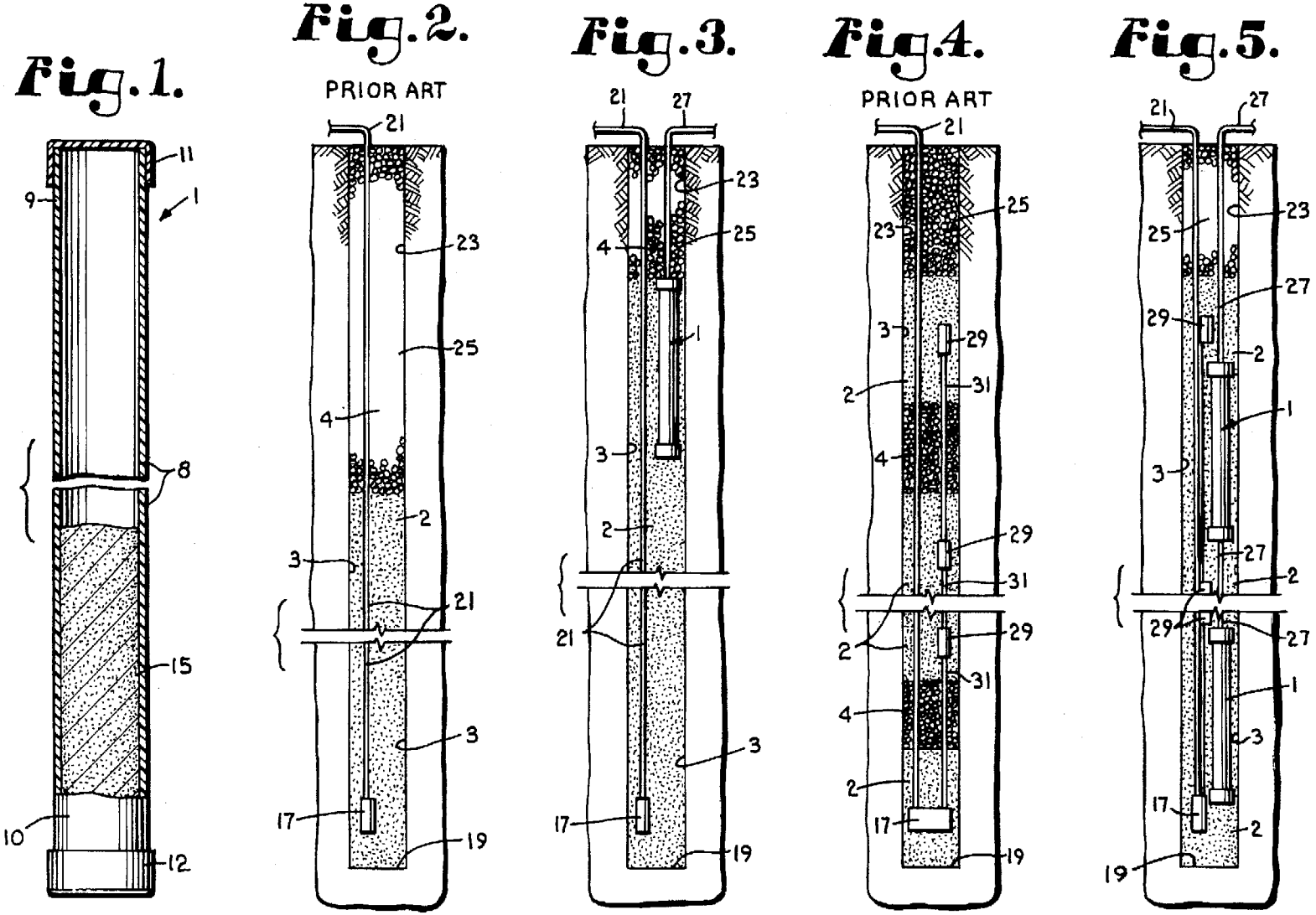
Fig.4. PRIOR ART
Fig.2. PRIOR ART
FIG. 1 is a longitudinal sectional view of an explosive displacing bore hole tube which embodies the present invention.
FIG. 2 is a diagrammatic sectional view of a bore hole illustrating a conventional arrangement for producing shot rock by blasting without producing fly rock.
FIG. 3 is a view similar to FIG. 2 and illustrates use of the explosive displacing robe of the present invention to produce shot rock without producing fly rock.
FIG. 4 is a diagrammatic sectional view of a bore hole illustrating a conventional arrangement for producing rip-rap by blasting.
FIG. 5 is a view similar to FIG. 4 and illustrates use of a plurality of explosive displacing tubes of the present invention to produce rip-rap.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates an explosive displacing bore hole tube which embodies the present invention. The tube 1 is generally used for displacing a portion of an explosive 2 at a desired location within a bore hole 3 to decrease the intensity of the blast at such a location when the explosive 2 is detonated. The explosive displacing tube 1 is used in place of a zone of bore hole cuttings 4 which is conventionally used for such a reduction in blast intensity when the explosive 2 is detonated.

Referring to FIG. 1, the explosive displacing tube 1 is formed by an elongated tubular member 8 having its opposite upper and lower ends 9 and 10 closed by respective upper and lower caps 11 and 12. The tubular member 8 is preferably formed of a plastic, such as PETG, rigid PVC, MDPE, polyethylene, or other lightweight material. The tubular member 8 may have a length of from two to eight feet and a wall thickness within a range of about 0.018 to 0.045 inch. The outer diameter of the tubular member 8 varies with the diameter of the bore hole 3 within which the tube 1 will be used. Preferably, the member 8 has an outer diameter about one-half the diameter of the bore hole 2. thus, for a bore hole of about five inches in diameter, the tubular member 8 has an outer diameter of approximately 2.5 inches. The wall thickness of the member 8 depends on the material used and also on the diameter of the tubular member 8. The member 8 should have sufficient rigidity to avoid being easily deformed during placement of the member 8 in the bore hole 3 and by hydrostatic pressure of the explosive 2.

The end caps 11 and 12 may be formed of vinyl, rubber, or other suitable material. Preferably, the caps 11 and 12 are frictionally retained on the ends 9 and 10 of the tubular member 8 for economy of manufacture and ease of assembly. The explosive displacing tube 1 is filled with an inert or nonexplosive material. Principally, such fill material is air at ambient pressure. In order to facilitate lowering the tube 1 into a bore hole 3 and to counteract a tendency toward buoyance within the explosive 2, a quantity of a ballast material 15 may be placed within the tube 1. Bore hole cuttings 4, formed during boring the hole 3, are readily available at blasting sites and may be used for this purpose. Alternatively, soil, sand, or other relatively dense granular material may be used. In some circumstances, it might be desirable to fill the tube 1 virtually completely with such ballast material 15. The purpose of the explosive displacing tube 1, so constructed, is to reduce but not completely eliminate, the volume of explosive 2 at one or more selected locations along a bore hole 3.

FIG. 2 illustrates a conventional arrangement for producing shot rock for processing by crushing machinery with reduced production of high velocity fly rock. The explosive 2 is loaded to a relatively high level within a bore hole 3 whereby upon detonation, the shock from the blast fractures the rock surrounding the bore hole 3. The remainder of the hole 3 is filled with bore hole cuttings 4. The explosive generally used in such operations is a mixture of ammonium nitrate and fuel oil, commonly referred to as ANFO. Such explosive is more economical and in many ways safer to handle than other explosives, such as dynamite. The ANFO explosive 2 is detonated by a detonator device 17, which may be an electrical cap and a booster such as a small charge of dynamite or other explosive. The detonator 17 is placed near the bottom of the hole 3 and is activated by a conventional "blasting gun" (not shown) which sends a high voltage pulse to the detonator 17 by way of a two conductor electrical cable 21.

A line of the holes 3 are bored at a given distance from a vertical rock face (not shown) to a selected depth, such as about sixteen feet. Each of the bore holes 3 for rock blasting are normally stemmed or plugged at a top end 23 to cause the blast to be directed more horizontally than vertically. Such a bore hole plug 25 may be formed of cuttings 4. In blasting to form shot rock, the column of explosive 2 is uninterrupted vertically. For this reason, the blast tends to propel high velocity rock or fly rock from the top end 23 of the hole 3. To reduce the production of fly rock, the conventional technique is to increase the length of the top end plug 25. An unintended consequence of this approach is that large rocks or boulders tend to be produced in the vicinity of the top end 23 of the bore hole 3 because of the absence of the explosive 2 at the top end 23. Such boulders are not generally suitable for processing in crushing machinery.

FIG. 3 illustrates the use of the explosive displacing tube 1 of the present invention to improve the blasting process to produce shot rock. The tube 1 is preferably filled with ballast 15 and is positioned just below the plug 25 which has a reduced length as compared to the plug 25 shown in FIG. 2. The tube 1 may be lowered into the hole 3, as by a rope 27. The tube 1 reduces the volume of explosive 2 near the top end 23 of the hole 3, and thereby reduces the production of fly rock. Additionally, the presence of the remaining volume of explosive 2 about the tube 1 causes greater fracturing of the rock surrounding the top end 23 of the hole 3, thereby also reducing a tendency to produce boulders. Also, with the use of the explosive displacing tube 1 in the upper stemming column, a straighter face 35 is left for subsequent shots. With a straighter face 35, a subsequently drilled hole 3 is more reliably located as the burden—the distance from the face 35 to the first row of bore holes 3—is more uniform. It should be noted that the tubes 1 are not shown to be one-half the diameter of the bore hole 3, for graphic convenience.

FIG. 4 illustrates a conventional technique for producing rip-rap or boulders in bore hole blasting. The bore hole 3 is decked with alternating layers of the explosive 2 and the cuttings 4. The spacing of the decking is determined by the size of rip-rap to be produced. Each zone of explosive 2 has a detonator 17 or a booster 29. The lowest zone of explosive 2 has an electrical detonator 17 which connects to the boosters 29 in layers thereabove by explosive primer cord 31. The boosters 29 are small charges of explosives which can be set off by the primer cord 31. The zones of the explosive 2 are detonated sequentially from the bottom 19 of the hole 3 toward the top 23. The detonator 17 is activated electrically through a cable 21, and the booster 29 in each succeeding layer is detonated by the primer cord 31. The placement of the explosive 2, the cuttings 4, and the boosters 29 is complex, time consuming and laborious.

FIG. 5 illustrates use of a plurality of the explosive displacing tubes 1 to produce rip-rap. The vertical spacing of the tubes 1 is similar to the spacing of the layers of the cuttings 4 in the conventional technique shown in FIG. 4. A string of the tubes 1, connected by a rope 27, may be lowered into the hole 3 along with the series of the boosters 29 and the electrical detonator 17. The explosive 2 is then poured in the hole 3 to fill in around the tubes 1, and a plug 25 of cuttings poured, shoveled or otherwise placed in the hole 3 to close the top end 23 of the hole 3. The reduced volume of explosive 2 about the tubes 1 combined with the zones of explosive 2 between the tubes 1 causes the rock to fracture in large size boulders as the zones of explosive 2 are detonated.

Figure 6:
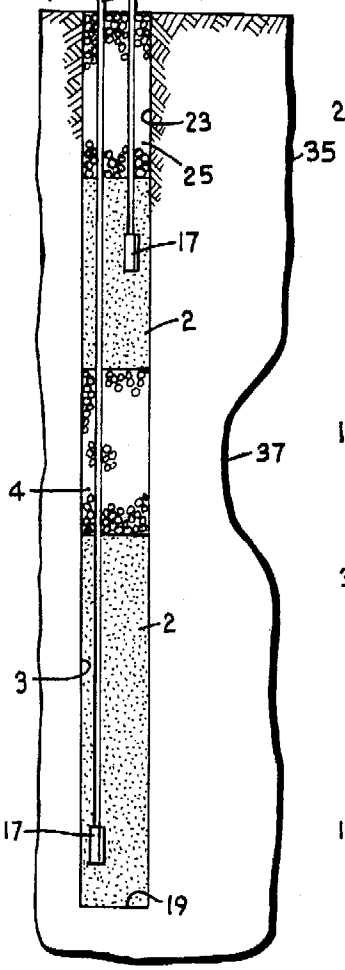
FIG. 6 is a diagrammatic sectional view of a bore hole illustrating a conventional arrangement for bore hole blasting to avoid producing fly rock from a blow-out in a rock face.

Bore hole blasting sometimes causes the formation of cavities in the rock face 35, which are referred to as blow-outs 37. When the next line of holes 3 are bored for the next stage of blasting, the proximity of the explosive 2 to the blow-out 37 tends to produce fly rock from the blow-out 37. To avoid this, the conventional technique, shown in FIG. 6, is to pack a layer of cuttings 4 in lateral alignment with the blow-out 37. A second one of the detonators 17 is required above the cuttings 4 to reliably detonate the explosive 2 above the cuttings 4.

Figure 7:
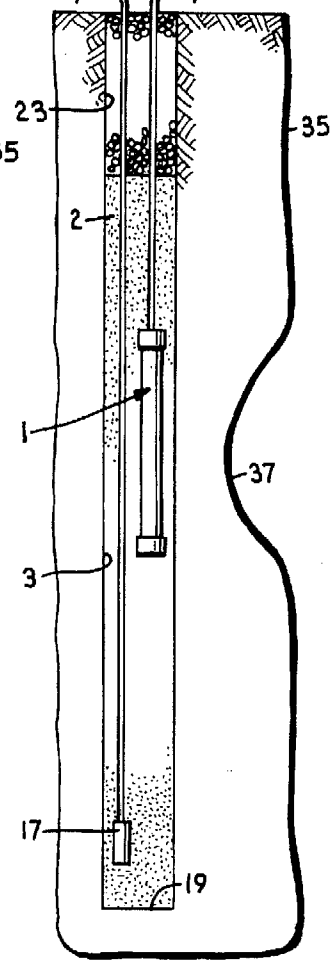
FIG. 7 is a view similar to FIG. 6 and illustrates use of an explosive displacing tube of the present invention to avoid production of fly rock from a blow out in a rock face during blasting.

FIG. 7 illustrates the placement of one of the explosive displacing tubes 1 in lateral alignment with the blow-out 37. The reduced volume of explosive 2 about the tube 1 reduces the blast intensity at the blow-out 37, thereby reducing the tendency to produce fly rock. Because the explosive 2 is continuous about the tube 1 from below to above it, a detonator 17 above the tube 1 is not required. Additionally, the setup time and labor are reduced by use of the explosive displacing tube 1 as compared with the conventional technique.

It is foreseen that more than one of the tubes 1, such as two or three of the tubes 1, may be used end to end for some blasting applications.

Figure 9:
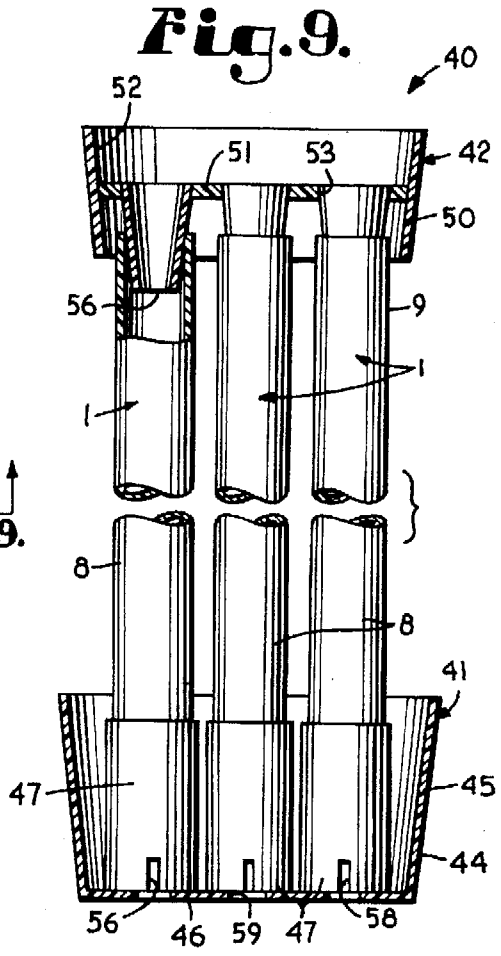
FIG. 9 is a diametric longitudinal sectional view taken on line 9—9 of FIG. 8 and illustrates further details of the displacement tube filler apparatus, according to the present invention.
Figure 8:
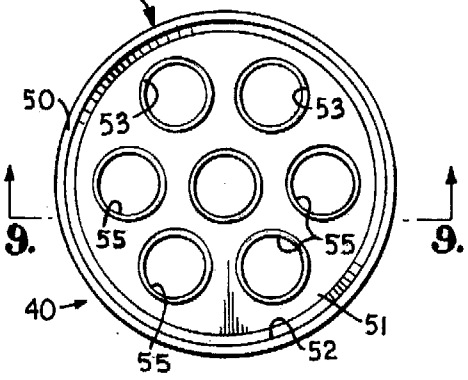
FIG. 8 is a top plan view of a displacement tube filler apparatus of the present invention for simultaneously placing ballast material in a plurality of the explosive displacing tube.

FIGS. 8 and 9 illustrate a tube filler arrangement 40 for simultaneously pacing ballast 15 into a plurality of the explosive displacing tubes 1. The arrangement 40 generally includes a lower tube support assembly 41 and an upper multiple funnel assembly 42. The illustrated tube support assembly 41 includes a pail member 44 including an outer peripheral wall 45 and a lower wall 46. A plurality of tube support sleeves 47 are secured to the lower wall 46 in a selected pattern and in upstanding parallel relation. The multiple funnel assembly 42 includes an outer peripheral wall 50 with a partition disk 51 engaging an inner surface 52 of the outer wall 50. The disk 51 has a plurality of funnel receiving apertures 53 formed therethrough in the same pattern as the pattern of the sleeves 47 in the tube support assembly 51. A frustoconical funnel member 55 is secured in each aperture 53 and has a lower end 56 extending below the partition disk 51.

In use, a plurality of tubular members 8, with their lower ends 10 capped, are inserted into the sleeves 47 of the tube support assembly 41. The multiple funnel assembly 42 is then placed on top of the tubular members 8 with the lower ends 56 of the funnel members 55 inserted into the upper ends 9 of the tubular members 8. Cuttings or other ballast material 15 may then be shoveled or poured into the top of the funnel assembly 42, and the funnel members 55 direct such ballast 15 into the tubular members 8. The sleeves 47 may be provided with slots 58 and the lower wall 46 of the pail 44 provided with relief apertures 59 to allow for the outflow of any ballast material 15 that may be spilled into the sleeves 47 or the pail 44.

It is to be understood that while certain forms of the present invention have been illustrated and described herein, it is not to be limited to the specific forms or arrangement of parts described and shown.

What is claimed and desired to be secured by Letters Patent is as follows:

1. An explosive displacing structure for use in combination with an explosive in a bore hole and comprising:

(a) an elongated tubular member having a selected length, a selected outer diameter, a selected wall thickness, and opposite ends;

(b) an end closure member secured to and closing each of said opposite ends of said tubular member; and (c) an inert material filling said tubular member; and (d) wherein said tubular member is configured to operably and selectively diminish the intensity of a blast from the explosive spaced alongside said tubular member.

2. A structure as set forth in claim 1 wherein said inert material is air.

3. A structure as set forth in claim 1 wherein said inert material includes rock gravel of a relatively small particulate size.

4. A structure as set forth in claim 1 wherein said tubular member is formed of a synthetic resin.

5. An explosive displacing structure for use in combination with an explosive in a bore hole and comprising:

(a) an elongated tubular member having a selected length, a selected outer diameter of approximately one half of a diameter of a bore hole in which said tubular member is to be used, a selected wall thickness, and opposite ends;

(b) an end closure member secured to and closing each of said opposite ends of said tubular member; and (c) an inert material filling said tubular member.

6. A structure as set forth in claim 1 wherein said outer diameter of said tubular member is approximately two and one-half inches.

7. A structure as set forth in claim 1 wherein said length of said tubular member ranges from two to eight feet.

8. A structure as set forth in claim 1 wherein each closure member is an end cap frictionally retained on a respective end of said tubular member.

9. A structure as set forth in claim 1 wherein said wall thickness of said tubular member ranges from about 0.018 to 0.045 inch.

10. A method of blasting a rock structure comprising the steps of:

(a) boring an elongated bore hole of a selected depth and a selected diameter into the rock structure;

(b) filling said bore hole with a flowable explosive to a selected height within said bore hole;

(c) displacing a portion of said explosive at a selected position along said bore hole by placing an explosive displacing structure at said selected position such that said explosive extends alongside said explosive displacing structure;

(d) plugging a top end of said bore hole; and (e) detonating said explosive.

11. A method as set forth in claim 10 wherein said displacing step includes the step of displacing said explosive at a plurality of selected positions along said bore hole using a respective explosive displacing structure placed at each of said selected positions.

12. A method as set forth in claim 10 for creating shot rock and including the step of positioning said explosive displacing structure at a top end of said bore hole, just below where said bore hole is plugged.

13. A method as set forth in claim 10 for creating rip-rap and including the steps of:

(a) positioning an explosive displacing structure at each of a plurality of spaced apart positions along said bore hole in such a spaced relation as to create a desired size of rip-rap; and (b) sequentially detonating portions of said explosive between said explosive displacing structures from a lower end of said bore hole to said top end.

14. A method as set forth in claim 10 wherein said bore hole is bored in the vicinity of a blow-out cavity in a rock face adjacent said bore hole and including the step of positioning said explosive displacing structure in substantially lateral alignment with said blow-out cavity.

15. A method as set forth in claim 10 and including the steps of:

(a) forming said explosive structure as an elongated tubular member having a selected length, a selected outer diameter, a selected wall thickness, and opposite ends; and (b) closing opposite ends of said tubular member to enclose a nonexplosive material within said tubular member.

16. A method as set forth in claim 15 and including the step of enclosing air at ambient pressure within said tubular member.

17. A method as set forth in claim 15 and including the step of enclosing a selected quantity of bore hole cuttings within said tubular member.

18. A method as set forth in claim 10 and including the step of forming said explosive displacing structure with an outer diameter approximately one-half said selected diameter of said bore hole.

19. A multiple funnel arrangement for simultaneously filling a plurality of elongated tubular members with a granular material and comprising:

(a) a tube support assembly including:

(1) a self-standing pail having a lower wall and a peripheral side wall;

(2) a plurality of sleeves connected to said lower wall in a selected pattern and in substantially upstanding parallel relation to receive a plurality of said tubular members sleeved respectively therein in substantially upstanding parallel relation;

(b) a funnel assembly including:

(1) a peripheral outer wall open on an upper side and a lower side;

(2) a transverse wall engaging an inner surface of said outer wall and having a plurality of funnel apertures formed therethrough in said selected pattern to enable alignment with said sleeves of said tube support assembly; and (3) a plurality of frustoconical funnel members secured respectively in said apertures with lower ends of said funnel members extending below said transverse wall; and (c) said funnel assembly being positioned on upper ends of a plurality of said tubular members positioned within said sleeves of said tube support assembly with said lower ends of said funnel members positioned within said upper ends of said tubular members to thereby direct granular material placed into said funnel assembly above said transverse wall into said tubular members.

20. An arrangement as set forth in claim 19 and including:

(a) a sleeve aperture formed through a lower end of each of said sleeves;

(b) at least one pail aperture formed through said lower wall of said pail; and (c) the sleeve apertures and said pail aperture cooperating to enable outflow of said granular material spilled into said sleeves and said pail.

21. A method of blasting a rock structure comprising the steps of:

(a) boring an elongated bore hole of a selected depth and a selected diameter into the rock structure;

(b) filling said bore hole with a flowable explosive to a selected height within said bore hole;

(c) displacing a portion of said explosive at a selected position along said bore hole by placing an explosive displacing structure at said selected position;

(d) forming said explosive displacing structure as an elongated tubular member having a selected length, a selected wall thickness, opposite ends, and a selected outer diameter wherein said outer diameter is approximately one-half said selected diameter of said bore hole;

(e) closing opposite ends of said tubular member to enclose a nonexplosive material within said tubular member;

(f) plugging a top end of said bore hole; and (g) detonating said explosive.

* * * * *

UNITED STATES PATENT AND TRADEMARK OFFICE

CERTIFICATE OF CORRECTION

PATENT NO. : 5,689,085

DATED : November 18, 1997

INVENTOR(S) : Wayne G. Turner

It is certified that error appears in the above-identified patent and that said Letters Patent is hereby corrected as shown below:

Column 2, line 57, delete "curings" and insert therefore --cuttings--. Column 3, line 60, delete "robe" and insert therefore --tube--.

Signed and Sealed this

Third Day of March, 1998

Bruce Lehman

*Attest:*

BRUCE LEHMAN

*Attesting Officer*

*Commissioner of Patents and Trademarks*